United States Patent [19]

Watkins

[11] Patent Number: 4,926,510

[45] Date of Patent: May 22, 1990

[54] HAND HELD DRY HYDRO-MASSAGE UNIT FOR A SPA

[75] Inventor: Jonathan Watkins, Vista, Calif.

[73] Assignee: Watkins Manufacturing Corporation, Carlsbad, Calif.

[21] Appl. No.: 261,943

[22] Filed: Oct. 24, 1988

[51] Int. Cl.[5] ..... A61H 9/00; E04H 3/18

[52] U.S. Cl. ..... 4/542; 128/64

[58] Field of Search ..... 4/541, 542; 128/64

[56] References Cited

U.S. PATENT DOCUMENTS

| | | | |
|---|---|---|---|
| 992,905 | 5/1911 | Robinson . | |
| 1,076,490 | 10/1913 | Dreuw | 128/64 |
| 2,591,252 | 4/1952 | Gilson . | |
| 3,273,560 | 9/1966 | Jzcuzzi . | |
| 3,297,025 | 1/1967 | Jacuzzi . | |
| 3,302,640 | 2/1967 | Jacuzzi . | |
| 3,396,722 | 8/1968 | Lindberg Jr. . | |
| 3,452,370 | 7/1969 | Jacuzzi . | |
| 3,540,438 | 11/1970 | Jacuzzi . | |
| 3,571,820 | 3/1971 | Jacuzzi . | |
| 3,674,020 | 7/1972 | Jacuzzi . | |
| 3,720,204 | 3/1973 | Wojtowicz . | |
| 3,736,924 | 6/1973 | Jacuzzi et al. . | |
| 3,768,462 | 10/1973 | Boulard . | |
| 3,806,964 | 4/1974 | Vanegas et al. . | |
| 3,820,173 | 6/1974 | Weller . | |
| 3,842,823 | 10/1974 | Jacuzzi et al. . | |
| 3,874,374 | 4/1975 | Jacuzzi . | |
| 3,905,358 | 9/1975 | Jacuzzi . | |
| 4,139,001 | 2/1979 | Macabee . | |
| 4,220,145 | 9/1980 | Stamp et al. . | |
| 4,335,854 | 6/1982 | Raynoso . | |
| 4,339,833 | 7/1982 | Mandell . | |
| 4,523,340 | 6/1985 | Watkins . | |
| 4,561,133 | 12/1985 | Laing . | |
| 4,575,882 | 3/1986 | Diamond . | |
| 4,655,572 | 5/1987 | Davidson et al. . | |
| 4,679,258 | 7/1987 | Henkin et al. . | |
| 4,692,950 | 9/1987 | Henkin et al. . | |
| 4,726,080 | 2/1988 | Henkin et al. . | |
| 4,727,605 | 3/1988 | Henkin et al. . | |
| 4,731,887 | 3/1988 | Henkin et al. . | |
| 4,757,808 | 7/1988 | Effler | 4/542 X |

FOREIGN PATENT DOCUMENTS

| | | | |
|---|---|---|---|
| 213041 | 5/1908 | Fed. Rep. of Germany | 4/541 |
| 2601506 | 1/1978 | Fed. Rep. of Germany | 4/541 |

*Primary Examiner*—Charles E. Phillips

*Attorney, Agent, or Firm*—Edgar A. Zarins; Malcolm L. Sutherland

[57] ABSTRACT

A hand-held dry hydro-massage unit for use in a spa tub to allow the user to direct the soothing effects of the hydro-therapeutic massage to specific portions of the body. The hand held unit is normally used in conjuction with a hydrotherapy spa tub to provide separate air and water supplies to the unit. The air and water are mixed by a discharge jet which forces the mixture onto the inside surface of a flexible diaphragm. The diaphragm encloses the unit such that the water is not discharged but is returned back through the supply line to the tub. The unit therefore provides a dry massage of the user eliminating the annoying water discharge and splash of conventional hydro-therapy devices.

15 Claims, 2 Drawing Sheets

HAND HELD DRY HYDRO-MASSAGE UNIT FOR A SPA

BACKGROUND OF THE INVENTION

I. Field of the Invention

This invention relates to a hydro-massage unit for a spa tub and, in particular, to a hand-held unit associated with a spa which provides a dry hydro-massage by eliminating the discharge of water and which can be manipulated by the user for the application to specific body parts both above and below the water line of the spa.

II. Description of the Prior Art

Whirlpool or hot tub spas are widely utilized for the soothing massage they provide in athletic, recreational and therapeutic settings. The more modern hydro-massage units direct a turbulent mixture of air and water into a spa tub. The discharge units are typically positioned below the water line in order to create a massaging turbulence within the tub while minimizing the splash of water. Attempts to raise the discharge above the water line creates an annoying splash. Furthermore, because the depth of the typical spa tub is designed to allow the user to sit while the water line is approximately at the user's torso, the massage of areas such as the neck and shoulders can prove difficult.

In order to provide a manipulable massaging unit, various hand-held shower massage devices have been developed for connection to a shower or bath. These hand-held devices use only a water spray and depend upon a rotating member to create a pulsating discharge. Any massaging effect is dependent upon the direct contact of the pulsating spray on the user's body and such devices are typically limited to use in a shower enclosure. Moreover, it has been found that although the pulsating sprayer provides some massaging effect, a turbulent mixture of air and water is more effective and soothing.

SUMMARY OF THE PRESENT INVENTION

The present invention overcomes the disadvantages of the prior known hydro-massage devices by providing a hand-held, manually manipulable hydro-massage unit for a tub spa which provides a dry massage by enclosing the discharge jet and directing the turbulent spray against a flexible diaphragm.

The hydro-massage unit according to the present invention is associated with a hydro-massage spa and is connected to the water and air supplies of the spa. A flexible hose extending from the rim of the spa tub allows complete manipulation of the unit and carries the water and air lines while acting as a return conduit for the discharged fluid. The unit includes a handle for the user to grasp and a massage head which encloses the discharge jet. The head includes a housing and a flexible diaphragm which covers the discharge nozzle of the jet. As the turbulent mixture is discharged by the nozzle, a fluid pressure will build up behind and expand the diaphragm while the turbulent discharge acts against the diaphragm. The massaging effect can be felt through the diaphragm and therefore the user merely needs to place the diaphragm on the body part to be massaged.

The housing and diaphragm form an enclosed environment preventing the fluid mixture from being discharged from the unit. The air and water are supplied to the discharge jet through separate supply lines. When the fluid is discharged, it will bounce off of the inner surface of the diaphragm and flow back into the housing. A restricted outlet passage will create a pressure build-up within the housing which expands the diaphragm to form a pillow. The handle and hose act as a fluid conduit to direct the discharged fluid back to the tub structure. Thus, any fluid splash or discharge from the hand-held unit is eliminated resulting in a dry hydro-massage which can be directed to specific body parts.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
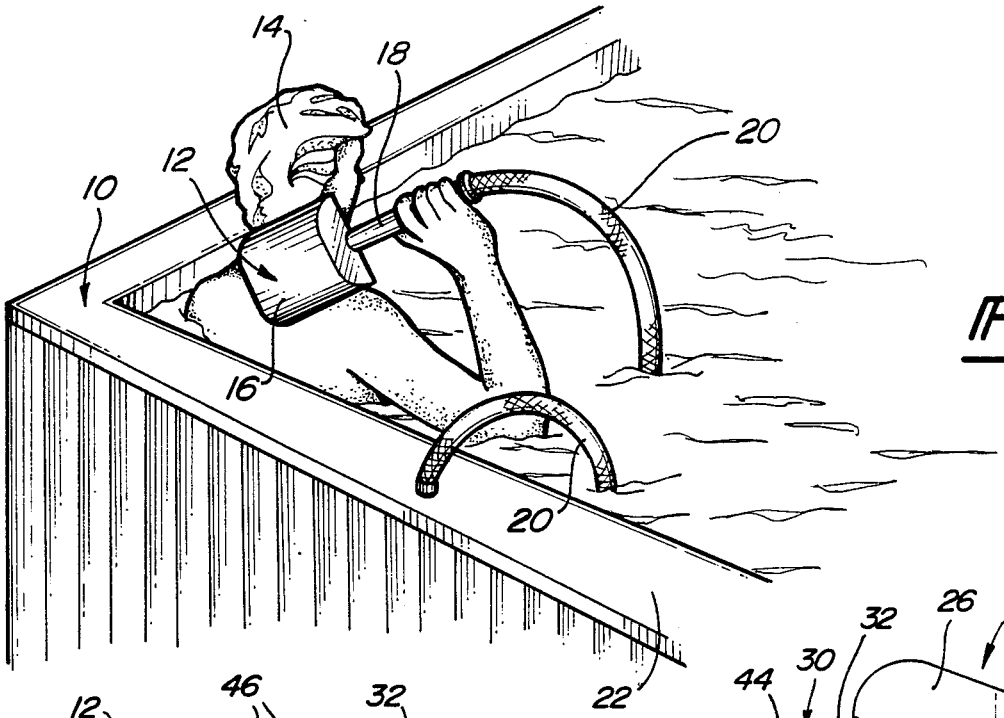
FIG. 1 is an elevated perspective view of a user in a tub spa embodying the hand-held dry hydro-massage unit of the present invention.

Referring first to FIG. 1, there is shown a spa tub 10 which incorporates the hand held dry hydro-massage unit 12 embodying the present invention. The dry hydro-massage unit 12 is designed to be easily manipulated by a user 14 in order to apply a therapeutic hydro-massage to specific body parts such as the neck and shoulders. The dry hydro-massage unit 12 provides the therapeutic affects of conventional hydro-massage devices while eliminating the water splash associated with past known assemblies and permitting almost unlimited manipulation for direct application of the massage to specific portions of the user's body. In a preferred embodiment of the present invention, the dry hydro-massage unit 12 is associated with a spa tub 10 and utilizes the water and air supplies of the spa 10. Alternatively, the dry hydro-massage unit 12 may be portable with pumps which can be connected to an appropriate source.

The dry hydro-massage unit 12 of the present invention generally comprises a housing 16 with a handle 18 to facilitate manipulation by the user 14 and a flexible hose 20 which connects the housing 16 to the air and water supplies. In a preferred embodiment the hose 20 is connected to the rim 22 of the spa tub 10 for communication with the supply pumps of the spa 10. The handle 18 has a tubular configuration which is readily grasped by the user 14. Preferably, the handle 18 is integrally formed with the housing 16 and both are made of a plastic or acrylic material. The hose 20 extends through the handle 18 for communication with the housing 16.

Figure 2:
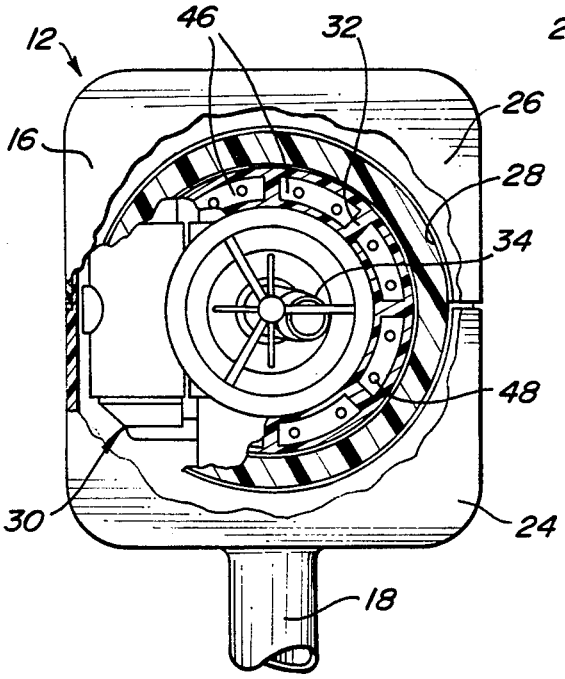
FIG. 2 is a front partial cross-sectional view of the hand-held unit embodying the present invention.
Figure 3:
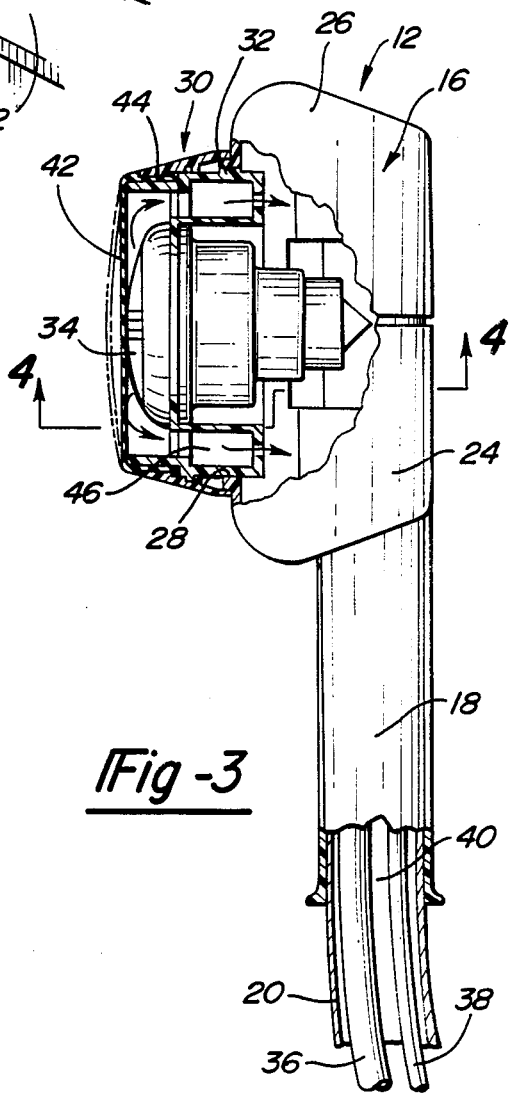
FIG. 3 is a side partial cross-sectional view of the hand-held unit embodying the present invention.
Figure 4:
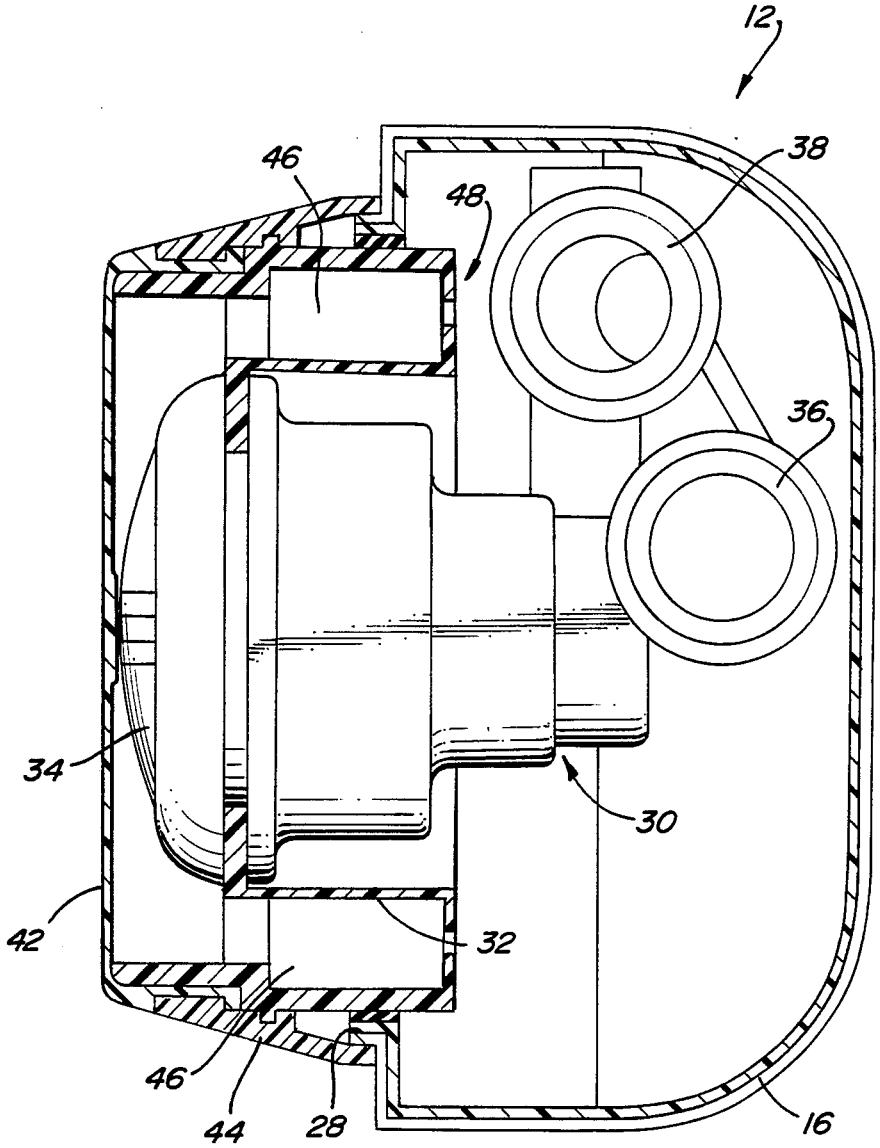
FIG. 4 is a cross-sectional perspective of the hand-held unit taken along lines 4—4 of FIG. 3.

Referring now to FIGS. 2 through 4, the housing 16 is of a two-piece construction with a base 24 and a cap 26 to facilitate assembly of the unit 12. The housing 16 has a front opening 28 within which a hydro-massage jet assembly 30 is disposed. The jet assembly 30 is retained within the housing 16 by a mounting bracket 32 which is matingly received within the opening 28. The bracket 32 receives and positions the jet assembly 30 within the housing 16. The hydro-massage jet assembly 30 includes a discharge nozzle 34 which directs a massaging fluid out of the housing 16. The massaging fluid preferably is air-entrained water supplied by the jet assembly 30. In the embodiment shown in FIG. 2, the discharge jet 34 is a rotating discharge nozzle which discharges massaging fluid in a circular motion. The water and air to produce the massaging fluid are supplied to the jet assembly 30 through a water supply line 36 and an air supply line 38 connected to the assembly 30. The hydro-massage jet assembly 30 utilizes a venturi jet to entrain the air into the water to produce the massaging fluid discharged through the nozzle 34. In a preferred embodiment, the water line 36 and the air line 38 extend through the flexible hose 20. Furthermore, the surrounding annulus 40 formed by the hose 20 acts as a return line to return the discharged fluid to the spa tub 10 as will be subsequently described.

The hydro-massage jet assembly 30 is positioned within the housing 16 so that the massaging fluid from the discharge nozzle 34 is directed out of the housing 16 through the opening 28. A flexible diaphragm 42 is sealingly positioned over the opening 28 to enclose the housing 16. In a preferred embodiment, the diaphragm 42 is attached to the mounting bracket 32 and secured thereon with a bezel 44 which engages the diaphragm 42, the mounting bracket 32 and the housing 16 to sealingly assemble the unit 12. With the diaphragm 42 attached to the housing 16, the massaging fluid is prevented from being discharged from the housing 16 except through the hose 20. The position of the diaphragm 42 relative to the jet assembly 30 ensures that the massaging fluid is discharged against the diaphragm 42. As a result, the diaphragm 42 will be massagingly flexed by the discharge fluid. Once discharged against the diaphragm 42 the fluid flows into the housing 16 and hose 20 through peripheral passageways 46. In a preferred embodiment, the passageways 46 include at least one restricted flow opening 48 formed in an end wall 50 of the passageway 46. By varying the size and number of openings 48 the fluid flow is limited creating a pressure build-up within the housing proximate the diaphragm 42. The increased pressure behind the diaphragm 42 will inflate the diaphragm 42 to form a more suitable massaging surface to be placed against the user's body. The means for restricting the flow can be provided elsewhere within the housing 16 or hose 20 to create the fluid pressure. As a result, the jet assembly 30 will discharge fluid into a pressurized environment against the diaphragm 42 to provide the necessary relief.

Operation of the dry hydro-massage unit 12 provides direct hydro-massage of specific portions of the anatomy without the annoying splash of past known hydro-massage devices. The size and weight of the present invention allows it to be easily maneuvered and positioned to provide soothing, therapeutic massage of a wide range of muscles not massageable in the spa tub. In addition, the hand held unit 12 can be utilized to provide direct massage while enjoying the general massaqe of the spa tub 10. Water and air are separately supplied through the lines 36 and 38, respectively, to the hydro-massage jet assembly 30. The jet assembly 30 entrains the air into the water and the massaging fluid is discharged through the nozzle 34 against the inner surface of the diaphragm 42. The fluid pressure behind the diaphragm 42 will increase to form a pillow-like configuration. The massaging effect of the fluid is communicated to the diaphragm 42 thereby massagingly flexing the diaphragm 42. The massaging fluid bounces off of the diaphragm 42 and flows back into the housing 16 through peripheral passageway 46 and into the annulus 40 formed by hose 20 for discharge into the tub 10. An air vent may be provided in the housing 16 to vent air from the massaging fluid which may become trapped within the housing 16. Thus, the dry hydro-massage unit 12 of the present invention provides the soothing effects of hydro-massage without the annoying discharge of fluid.

The foregoing detailed description has been given for clearness of understanding only and no unnecessary limitations should be understood therefrom as some modifications will be obvious to those skilled in the art without departing from the scope and spirit of the appended claims.

I claim:

1. A hand held dry hydro-massage unit for applying dry hydro-massage to specific portions of a user's body, said unit associated with a spa tub having a water and an air supply, said dry hydro-massage unit comprising:

a rigid housing having a front opening;

a hydro-massage jet assembly having a discharge nozzle mounted within said housing, said hydro-massage jet assembly supplying a massaging fluid mix of air and water through said discharge nozzle;

means fluidly connecting said hydro-massage jet assembly to the water and air supply of the tub for the supply of water and air to said hydro-massage jet assembly; and a diaphragm sealingly covering said opening of said housing whereby said massaging fluid mix of air and water from said discharge nozzle massagingly flexes said diaphragm;

means for restricting outlet flow of discharged fluid from said housing thereby increasing the fluid pressure within said housing to expand and maintain said diaphragm in a substantially constant inflated state beyond said front opening so as to provide a pillow-like surface to contact the user, said discharge jet discharging fluid into the pressurized fluid environment and against said expanded diaphragm, said dry hydro-massage unit manually manipulable such that said diaphragm covered discharge nozzle may be selectively positioned against specific portions of the user's body.

2. The unit as defined in claim 1 wherein said housing includes an integral handle for manipulating said unit.

3. The unit as defined in claim 2 wherein said means for supplying water and air to said jet assembly includes a water supply line and an air supply line, said supply lines extending between the water and air supplies in the spa tub to said hydro-massage jet assembly for discharge through said discharge jet.

4. The unit as defined in claim 3 and further comprising a flexible hose extending between said housing handle and the spa tub, said water supply line and said air supply line disposed within said flexible hose, said flexible hose operating as a discharged fluid return to direct the discharged fluid away from said housing.

5. A hand held dry hydro-massage unit for applying a dry hydro-massage to specific portions of a user's body, said unit associated with a spa tub having a water and an air supply, said dry hydro-massage unit comprising:

a rigid housing having a front opening and integral handle to facilitate manipulation by the user;

a hydro-massage jet assembly having a discharge nozzle, said jet assembly mounted within said manipulable housing and supplying a massaging fluid through said discharge nozzle;

a diaphragm sealingly covering said opening of said housing whereby said massaging fluid from said discharge nozzle massagingly flexes said diaphragm;

a water supply line for supplying water to said jet assembly and an air supply line for supplying air to said jet assembly, said supply lines connected at a first end to said jet assembly within said manipulable housing and at a second end to the water and air supply of the spa tub; and means for returning the discharged massaging fluid from said housing to the spa tub;

means for restricting outlet flow of discharged fluid from said housing thereby increasing the fluid pressure within said housing to expand and maintain said diaphragm in a substantially constant inflated state beyond said front opening so as to provide a pillow-like surface to contact the user, said discharge jet discharging fluid into the pressurized fluid environment and against said expanded diaphragm, said dry hydro-massage unit manually manipulable such that said diaphragm covered discharge nozzle may be selectively positioned against specific portions of the user's body while discharge of massaging fluid against the user's body is prevented.

6. The unit as defined in claim 6 wherein said means for restricting fluid flow includes a partition wall having at least one fluid port, said wall disposed within said housing between said diaphragm and said fluid return means.

7. The unit as defined in claim 6 wherein said means for returning the discharged massaging fluid to the spa tub comprises a flexible hose connected to said housing and the spa tub, said water and air supply lines disposed within said flexible hose.

8. The unit as defined in claim 7 wherein said housing handle is tubular, said flexible hose and said water and air supply lines extending through said handle.

9. The unit as defined in claim 5 wherein said jet assembly includes a venturi jet for providing a massaging fluid of air-entrained water against said diaphragm.

10. The unit as defined in claim 9 wherein said discharge nozzle is a rotating discharge nozzle providing massaging fluid against said diaphragm in a circular motion.

11. A hand held dry hydro-massage unit for applying a dry hydro-massage to specific portions of a user's body, said dry hydro-massage unit comprising:

a rigid housing having a front opening and an integral tubular handle extending from the bottom of said housing, said handle facilitating manipulation of said unit by the user;

a hydro-massage jet assembly having a discharge nozzle, said jet assembly mounted within said housing and supplying a massaging fluid through said discharge nozzle;

a diaphragm sealingly covering said opening of said housing whereby said massaging fluid from said discharge nozzle massagingly flexes said diaphragm;

a water supply line connected to said jet assembly and an air supply line connected to said jet assembly, said jet assembly including a venturi jet for discharging a massaging fluid of air-entrained water against said diaphragm; and a discharge fluid line for removing the discharged massaging fluid from said housing;

means for restricting outlet flow of discharged fluid from said housing thereby increasing the fluid pressure within said housing to expand and maintain said diaphragm in a substantially constant inflated state beyond said front opening so as to provide a pillow-like surface to contact the user, said discharge jet discharging fluid into the pressurized fluid environment and against said expanded diaphragm.

said dry hydro-massage unit manually manipulable such that said diaphragm covered discharge nozzle may be selectively positioned against specific portions of the user'body while discharge of massaging fluid against the user'body is prevented.

12. The unit as defined in claim 11 wherein said discharge fluid line comprises a flexible hose extending from said tubular handle, said water and air supply lines disposed within said flexible hose.

13. The unit as defined in claim 12 wherein the remote end of said flexible hose is connected to the rim of a spa tub, the spa tub supplying the water and air through said supply lines and receiving the discharged massaging fluid through said discharge fluid line, the spa tub including means for supplying water and air through said supply lines.

14. The unit as defined in claim 11 wherein said discharge nozzle is a rotating discharge jet providing massaging fluid against said diaphragm in a circular motion.

15. The unit as defined in claim 11 wherein said flow restricting means includes a partition disposed within said housing, said partition having at least one outlet port.

* * * * *